US005230672A

United States Patent [19]

Brown et al.

[11] Patent Number: 5,230,672

[45] Date of Patent: Jul. 27, 1993

[54] COMPUTERIZED EXERCISE, PHYSICAL THERAPY, OR REHABILITATING APPARATUS WITH IMPROVED FEATURES

[75] Inventors: Michael L. Brown, Jeffersonville, Ind.; Michael R. Starcher, Louisville, Ky.; Jan W. Miller, Louisville, Ky.; Dean M. Zigoris, Louisville, Ky.

[73] Assignee: Motivator, Inc., Louisville, Ky.

[21] Appl. No.: 668,588

[22] Filed: Mar. 13, 1991

[51] Int. Cl.[5] ..... A63B 24/00

[52] U.S. Cl. ..... 482/4; 482/8; 482/111; 482/902; 482/908; 73/379.09; 73/1 B; 364/571.03

[58] Field of Search ..... 482/1, 4, 5, 8, 91, 482/100, 111, 112, 113, 137, 901, 902, 908; 128/25 R, 25 B; 73/379; 364/571.03, 571.01; 33/356

[56] References Cited

U.S. PATENT DOCUMENTS

| | | | |
|---|---|---|---|
| 3,465,592 | 9/1969 | Perrine | 482/5 |
| 4,235,437 | 11/1980 | Ruis et al. | 482/5 |
| 4,354,676 | 10/1982 | Ariel | 482/5 |
| 4,464,725 | 8/1984 | Briefer | 364/571.03 |
| 4,465,274 | 8/1984 | Davenport | 482/113 |
| 4,609,190 | 9/1986 | Brentham | 482/901 X |
| 4,705,271 | 11/1987 | Mondloch et al. | 482/112 |
| 4,765,611 | 8/1988 | MacMillan | 482/112 X |
| 4,846,458 | 7/1989 | Potts | 482/113 X |
| 4,863,161 | 9/1989 | Telle | 482/112 X |
| 4,907,797 | 3/1990 | Gezari et al. | 482/901 X |
| 4,919,418 | 4/1990 | Miller | 482/8 X |
| 4,949,951 | 8/1990 | Deola | 482/102 X |
| 5,166,892 | 11/1992 | Inoue et al. | 364/571.03 X |

*Primary Examiner*—Richard J. Apley
*Assistant Examiner*—Joe Cheng
*Attorney, Agent, or Firm*—Middleton & Reutlinger

[57] ABSTRACT

A computerized exercise, physical therapy, or rehabilitation apparatus with improved features. The computerized exercise apparatus permits concentric and eccentric isokinetic exercise by a user where apparatus calibration is accurately determined before exercise to compensate for the user selected force application device, the push assembly, if used, and environmental factors; where hydraulic flow can be accurately controlled by use of an alternating current dither circuit; where multiple user force application devices, a push assembly, and a detachably connectable operator support are available for a myriad of exercises; and where the instantaneous forces measured during user exercise are displayed to the user in such a novel way so as to motivate the user to maximize their exercise efforts and thereby obtain increased personal benefit.

6 Claims, 10 Drawing Sheets

FIG. 2—INTERFACE LOGIC BOARD (210)

FIG. 3-POWER CONTROL MODULE (250)

FIG. 4—DITHERING CIRCUIT

COMPUTERIZED EXERCISE, PHYSICAL THERAPY, OR REHABILITATING APPARATUS WITH IMPROVED FEATURES

BACKGROUND OF THE INVENTION (a) Field of the Invention

The present invention relates to a computerized exercise apparatus generally used for exercise, physical therapy, or rehabilitation having improved features. More particularly, the computerized exercise apparatus permits concentric and eccentric isokinetic exercise by a user where apparatus calibration is accurately determined before exercise to compensate for the user selected force application device, the push assembly means, if used, and environmental factors; where hydraulic flow can be accurately controlled by use of an alternating current dither circuit; where multiple user force application devices, a push assembly means, and a detachably connectable operator support are available for a myriad of exercises; and where the instantaneous forces measured during user exercise are displayed to the user in such a novel way so as to motivate the user to maximize their exercise efforts and thereby obtain increased personal benefit.

(b) Description of the Prior Art

The world of exercise equipment has grown from the days of bar bells and free weights. There are exercise machines having a user selectable weight and a system of levers, pulleys, chains, and other hardware such that a user can lift and lower the selected weight for the exercise the machine is designed to accomplish. These machines are of the type known under the trademarks "UNIVERSAL" and "NAUTILUS". All of these have the disadvantage that the same weight is used for both lifting and lowering and for each repetition of the exercise, unless the user interrupts his routine to change the weight amount.

Exercise equipment using an adjustable hydraulic piston and cylinder for variable user force application is taught in European Patent Application 0,135,346 to Wu. Wilson U.S. Pat. No. 4,063,726, teaches an electronically controlled exercising system which proportions the exercise resistance in the two directions of piston movement using a variable speed pump motor and a series of open or closed valves. Useldinger et al U.S. Pat. No. 4,307,608, teaches using the output of a load cell to determine peak force applied to the load cell under tension or compression and displaying this peak force to the user while the user is exercising.

Other devices which couple an exercise apparatus to a computer to allow for a programmed or selected exercise routine and to display some results of the exercise are taught. Sweeney Jr. U.S. Pat. No. 4,358,105, teaches an exercise cycle which is programmable to simulate cycling over a level or hilly path and displays variables such as hill profile, calories, and time of exercise through a series of light displays. Voris U.S. Pat. No. 4,765,613, teaches a varying resistance lifting mechanism which has a microprocessor which controls the resistance and calculates the user performance and displays this performance to the user.

Kolomayets et al U.S. Pat. No. 4,714,244, teaches a rowing machine having a video display which displays user instructions and the user's performance in relation to a "PACER" boat, along with landscapes and buoys. The "PACER" boat speed is varied by a microprocessor dependant upon the difficulty and duration of the exercise selected by the user. Nobuta U.S. Pat. No. 4,735,410, also teaches a rowing machine having a cathode ray tube display which allows a user to simulate rowing against various currents and winds and in waters having shorelines and obstacles.

Finally, Miller U.S. Pat. No. 4,919,418, teaches a computerized drive mechanism for exercise, physical therapy and rehabilitation which provides for isokinetic exercise reciprocating between the concentric and compulsory isokinetic eccentric modes. Improvements to the mechanisms taught in the Miller patent are the focus of this patent.

DEFINITIONS

Throughout the application the following terms are used as defined below.

(a) Isokinetic: exercise where the speed of exercise motion is held constant during a dynamic contraction, so that external resistive force varies in response to magnitude of muscular force.

(b) Concentric: exercise where there is movement in the direction force is applied, for example, a bar bell being lifted from the floor.

(c) Eccentric: exercise where there is movement in the direction opposite to the direction of the force applied, for example, a bar bell being lowered to the floor.

(d) Compulsory isokinetic eccentric: constant velocity movement regardless of resisting force imposed by the user.

SUMMARY OF THE INVENTION

The present invention is for an improved computerized exercise apparatus which permits concentric and eccentric exercise by a user. Furthermore, in the improved apparatus, calibration is accurately determined before exercise to compensate for the user selected force application device, the push assembly means, if used, and environmental factors. Even further, in the improved apparatus, hydraulic fluid flow is accurately controlled by the use of an alternating current dither circuit. Also, in the improved apparatus, in order to greatly increase the utility of the apparatus, a variety of user force application devices, a push assembly means, and a detachably connectable operator support are available for the user, depending on the exercise selected. Additionally, the improved apparatus implements innovative video screen displays which present comparisons of past and present exercise routines by repetition to motivate the user to maximize his or her exercise effort in order to obtain the maximum personal benefit from the exercise.

More particularly, the present invention comprises an improvement to an exercise apparatus having a linearly extendable and retractable tension transmitting device having a first end detachably connected to a user selected force application device and a second end connected to a movement control means which regulates the extension and retraction of the tension transmitting device, said control means being operably connected to a force measuring device which determines the tension applied to said tension transmitting device and provides an electronic signal representing this tension to a control computer, the improvement which comprises: means for calibrating the exercise apparatus to compensate for the user selected force application device and changes in environmental factors, and the push assembly means, if used.

Additionally, the present invention comprises an improvement to an exercise apparatus having movement control means comprising a hydraulic cylinder containing a piston connected to a piston rod extending from said hydraulic cylinder and a hydraulic pump system to provide a desired hydraulic fluid flow through hydraulic lines to said hydraulic cylinder by the use of a bidirectional proportional flow control valve in said hydraulic lines, the improvement which comprises: means for dithering said proportional flow control valve.

Furthermore, the present invention comprises an improvement to an exercise apparatus having a supporting structure, a tension transmitting device supported by said supporting structure and a user force application device detachably connectable to said tension transmitting device, the improvement which comprises: a push assembly means pivotally connected to said supporting structure and detachably connectable to said tension transmitting device and said user force application device, wherein said tension transmitting device and said user force application device are detachably connected to said push assembly means instead of each other.

Also, the present invention comprises an improvement to an exercise apparatus having a computer video monitor, the improvement which comprises: displaying, at the start of a new exercise routine, at the bottom of the video monitor in a first color, the force exerted by the user during the last exercise routine for both concentric and eccentric cycles in a series of vertical bar-graphs corresponding to the number of repetitions previously performed; displaying for each repetition a pair of horizontal bar-graphs at the top of the video monitor, the first horizontal bar-graph in the first color representing force exerted by the user during the comparable repetition in the last exercise routine, the second horizontal bar-graph in a second color representing force exerted by the user which is less than or equal to the force exerted in the last exercise routine and in a third color representing force exerted by the user which exceeds the force exerted in the last exercise routine; displaying, at the bottom of the video monitor in the second and third color, if applicable, in a vertical bar-graph, the results of each repetition of the new exercise routine as completed, the vertical bar-graph being adjacent to the displayed comparable repetition bar-graph from the last exercise routine.

Finally, the present invention comprises an improvement to an exercise apparatus having a support structure having a base having threaded holes therein, the improvement which comprises: an adjustable operator support, said operator support being detachably connectable to said base of said support structure, said operator support having front and rear horizontal leg assemblies, said front horizontal leg assembly being shorter that said rear horizontal leg assembly to compensate for the thickness of said base of said support structure, said front horizontal leg assembly having a pair of holes therein, a pair of retractable spring loaded screw down assembly means attached to said holes in said front horizontal leg assembly, wherein when said adjustable operator support is to be detachably connected to said base of said supporting structure, said pair of retractable spring loaded screw down assembly means are aligned with said threaded holes in said base of said support structure and then screwed into said threaded holes by the user.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

The implementation of the robotic fitness machine is encompassed in four major systems: mechanics, hydraulics, electronics, and software.

Figure 1:
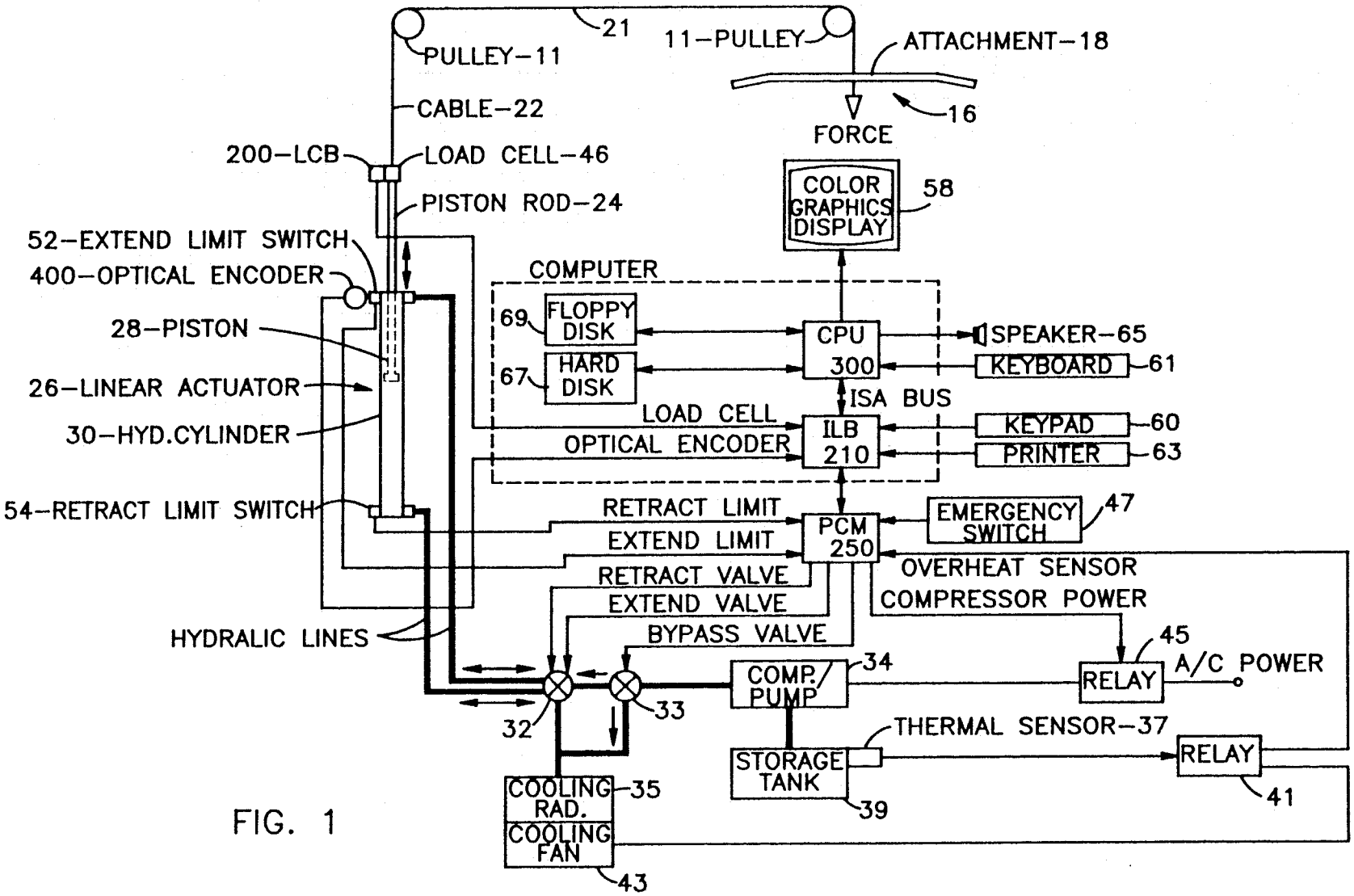
FIG. 1 shows the connectivity of the mechanics, hydraulics, and electronics systems of the exercise apparatus of the preferred embodiment.

FIG. 1 shows a schematic interconnection of the first three of these systems, shown as a pull-down apparatus. The user applies force to a selected user force application device 16 which is connected to a tension transmitting device 21. In this figure, the user force application device attachment 16 shown is a pull-down bar 18 and the tension transmitting device 21 is a flexible cable 22. Flexible cable 22 is supported by pulleys 11 connected to a supporting structure, which is not shown in this figure. The force applied by the user creates cable tension which is transmitted to a load cell 46. The load cell 46 senses the force applied and provides a voltage proportional to that force. The voltage is amplified to a proper working level and filtered to remove electrical noise. This is done within the Load Cell Board (LCB) 200. The amplified signal is sent to the Interface Logic Board (ILB) 210. An analog-to-digital converter, not shown in this figure, converts the signal from analog to digital. This digital signal is available to the central processing unit (CPU) 300 and hence provides digital force reading samples to software executing on the CPU 300.

The load cell 46 is attached to the moving end of a piston rod 24, which is part of the linear actuator system 26. It is noted that an electrical linear actuator could be used instead of the hydraulic linear actuator now described. Piston rod 24 is connected to a piston 28 which is inserted into hydraulic cylinder 30 containing hydraulic fluid. Also, a rotational optical encoder 400 is mechanically linked to the moving end of the piston rod 24. The optical encoder 400 generates signals indicative of the position displacement and direction of movement of the piston rod 24. These signals are fed to the ILB 210, which in turn provides this position and direction of movement information to the CPU 300. The signals generated by the optical encoder 400 provide a relative distance measure. Magnetically controlled limit switches 52 and 54 on either end of the hydraulic cylinder 30 provide absolute position references, indicating piston rod 24 being fully extended or fully retracted, respectively. These extend limit and retract limit signals are fed into the Power Control Module (PCM) 250.

Computer controlled movement of the piston rod 24 is implemented with the ILB 210 and PCM 250. A bidirectional proportional flow valve 32 is controlled by the PCM 250. The control signals are derived from the ILB 210 and sent to the PCM 250. The bidirectional proportional flow valve 32 allows the piston rod 24 to move in or out of hydraulic cylinder 30 at any programmed rate, limited only by the physical limits of the hydraulic pump/compressor 34. Direction of movement of piston rod 24 is controlled by the bidirectional proportional flow valve 32, which is electrically controlled by the computer. Proportional flow valve 32 comprises two solenoid valves. Each solenoid valve controls inlet flow to a given end of hydraulic cylinder 30. Adjusting current through the solenoid coil controls the flow-rate of the hydraulic fluid. A dithering circuit is used to alleviate friction in the solenoid spool. This circuit is described in detail later. A bypass valve 33, also computer controlled, provides a means for the hydraulic fluid to bypass the hydraulic cylinder 30 and flow through the cooling radiator 35. This provides an expedient means to cool the hydraulic fluid. A thermal sensor 37 located in the hydraulic fluid storage tank 39 energizes a relay 41 which energizes a cooling fan 43 on the cooling radiator 35 when the temperature reaches an overheat temperature. Also, at this overheat temperature, a signal is sent to the CPU 300 via PCM 250 and ILB 210 to alert of this overheat condition. Power to hydraulic pump/compressor 34 is controlled by a relay 45, controlled by the computer. Emergency switch 47, when activated, causes the piston rod 24 to fully extend from hydraulic cylinder 30 to the extend limit through software means.

Input from and output to the user is accomplished by a specialized keypad 60, a standard typewriter-type keyboard 61, a printer 63, a speaker 65 and a color-graphics video monitor 58. Most of the user input occurs from the keypad 60, through the ILB 210. Feedback to the user is provided by the video monitor 58 and an audio speaker 65. The software generates real-time images in reference to the forces generated on the cable 22. A hard disk 67 provides database storage capability, the floppy disk 69 provides a means to transfer data between one or more computers.

The computer system maintains control over all other portions of the apparatus. As an overview, interfacing the computer to the physical system is accomplished by three electronic subassemblies: the Interface Logic Board (ILB) 210, Power Control Module (PCM) 250, and the Load Cell Board (LCB) 200. The ILB 210 is directly connected to the computer system and provides the interface between the CPU 300 and the physical controls. The PCM 250 drives high-current components such as solenoid valves and relay coils in the hydraulics system, as previously discussed. The PCM 250 isolates these components from the computer system hardware. The LCB 200 properly amplifies the weak signal generated by the load cell 46, used to measure tension on tension transmitting device 21. The LCB 200 may be physically located on load cell 46. LCB 200 also provides a means of implementing a low impedance driver. Both the PCM 250 and the LCB 200 connect to the ILB 210. Software controls elements of the ILB 210, which, in turn, controls various physical hydraulic functions. The ILB 210 also contains the necessary circuitry to convert load cell 46 signals from analog to digital, decode quadrature pulses from optical encoder 400, and decode key presses from keypad 60. ILB 210, PCM 250, and LCB 200 are now explained in greater detail.

Figure 2:
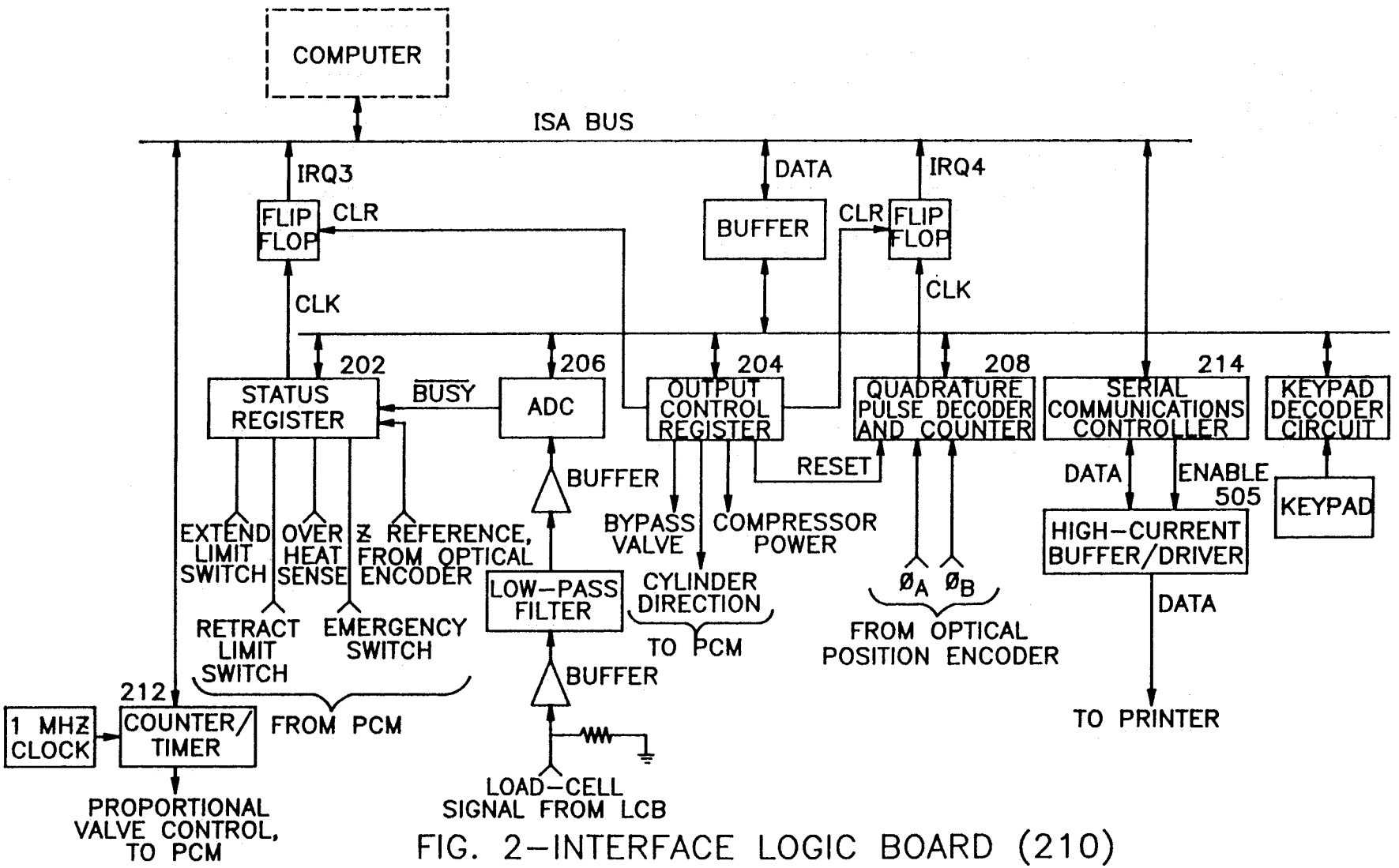
FIG. 2 shows connectivity of the Interface Logic Board.

FIG. 2 shows the connectivity of the ILB 210. ILB 210 provides the interfacing between the CPU 300 and all electrical features of the machine. There are seven major components of ILB 210: status register 202, output control register (OCR) 204, analog-to-digital converter (ADC) 206, quadrature-pulse decoder/counter 208, matrix keypad decoder 210, counter/timer circuit 212, and serial communications controller 214.

The status register 202 provides information about the physical state of the machine. It is a read-only register and has the following layout:

| Bit | Status |
|---|---|
| 0 | Keypad data available. |
| 1 | ADC busy. |
| 2 | Limit switch, top-of-cylinder. |
| 3 | Limit switch, bottom-of-cylinder. |
| 4 | Emergency extension switch. |
| 5 | Over-temperature detected. |
| 6 | Optical encoder Z reference output. |
| 7 | Reserved. |

Bit 0, when active, signals that a key was pressed on the keypad 60. Bit 1 is active when the ADC 206 is busy, during a conversion. Bit 2 is active when the piston rod 24 is completely extended from hydraulic cylinder 30. This condition is tripped by a magnetic limit switch 52, which is mounted at the top of the cylinder 30. Bit 3 is active when the piston rod 24 is completely retracted into cylinder 30. Magnetic limit switch 54, mounted at the bottom of cylinder 30 detects this condition. Bit 4 reflects the state of a push-button switch 47 used in emergency circumstances. Bit 5 is active when the hydraulic fluid is elevated to a given temperature, as designated by a thermal sensor 37 located in the hydraulic fluid storage tank 39. Bit 6 is connected to the optical encoder 400, which tracks the position of the piston rod 24, and produces a Z output signal. A pulse appears on the Z output every 1 revolution of the optical encoder 400. Bit 7 is not used in this preferred embodiment.

The output control register (OCR) 204 provides electrical control over a number of the hydraulic components. It is a bit addressable register. Its layout is as follows:

| Bit | Function |
|---|---|
| 0 | High-order byte enable for ADC. |
| 1 | Reset quadrature-decoder counter. |
| 2 | Clear interrupt request 4. |
| 3 | Clear interrupt request 3 |
| 4 | Hydraulic compressor power. |
| 5 | Bypass valve energize. |
| 6 | Cylinder direction. |
| 7 | High-order byte enable for quadrature-decoder. |

Bit 0 is used to control access to the high/low order data bytes from the ADC 206. The ADC 206 has a 12 bit output, therefore, two bytes are necessary for a complete data sample. Bit 1 is used to reset the position counter in the quadrature-decoder 208. Bit 2 is used to clear interrupt request 4 which is generated by the quadrature-decoder 208. Bit is used to clear interrupt request 3 which is generated by the limit switches 52 and 54, overheat sense relay 41, and emergency switch 47. Bit 4 engages the hydraulic compressor/pump 34. Bit 5 engages the hydraulic bypass valve 33. Bit 6 controls the direction of movement of piston rod 24, either in or out of hydraulic cylinder 30. Bit 7 allows high/low order byte access for the quadrature decoder 208.

The analog-to-digital converter (ADC) 206 is used to obtain measurements representing the force exerted on the tension transmitting device 21 and detected by load cell 46. The ADC 206 features a minimum of 12 bits precision. An important feature is the input buffer section. A voltage directly proportional to force exerted is received as an input to the ILB 210, this signal is then fed to an operational amplifier with an input impedance set to approximately 2.2k Ohms for increased tolerance to noise. The operational amplifier provides a buffering and filtering function. A low pass filter is used to eliminate RF interference and noise. This filter has a cut-off frequency of no less than 10 Hz. An extra operational amplifier buffer is placed between the filter circuit and the input to ADC 206. Power to the operational amplifier and ADC 206 is isolated by a dedicated voltage regulator augmented with isolation resistors and capacitors. The ADC 206 itself is a standard off-the-shelf type integrated circuit.

The quadrature-decoder 208 is used to convert signals from a rotary optical position encoder 400 to a position count value. The optical encoder 400 has two outputs which provide signals representing the amount of rotation of the encoder 400 and the direction of rotation. This information is maintained on a position counter internal to decoder 208, thus providing the position of the piston rod 24 anywhere in its travel to an accuracy limited only by the encoder 400 itself. The selected encoder 400 should have a minimum accuracy of 1/6 of an inch, linear travel. An interrupt (IRQ4) is generated when the decoder 400 has detected motion of the piston rod 24 in either direction.

The keypad matrix-decoder 210 uses an off-the-shelf integrated circuit to scan a momentary matrix keypad 60 for depressed keys. This circuit features key decoding and debounce. The decoding procedure derives a key code value for each key per row/column. The debouncing feature eliminates mechanical bouncing of the switch contact when a key is pressed.

The counter/timer 212 is an off-the-shelf integrated-circuit providing timing functions. Its principal use is to develop a pulse-width modulated signal to drive the bidirectional proportional flow control valve 32. It provides 3 timer channels. One channel is used to develop a square-wave signal for use as a basis for pulse-width modulation. The second channel outputs the pulse-width modulated signal to the PCM 250 for use in the proportional flow control valve 32. The third channel is used for software timing functions, determining the piston rod 24 velocity during operation.

The serial communications controller 214 is based on an off-the-shelf integrated circuit and provides a means of communicating with a serial printer 63 or provides a communications network interface function to interface with other similar apparatuses. The unique portion of this circuit is the output section 505. Serial encoded information is passed to the output drivers which offer high-current drive for lengths of cable up to 500 feet in length. The output section features a software controlled means of electrically disconnecting the transmitter driver from the communications wire external to the apparatus. This provides a means for a multiple-receiver, single-transmitter networking scheme for use in file and peripheral (printer) sharing.

Figure 3:
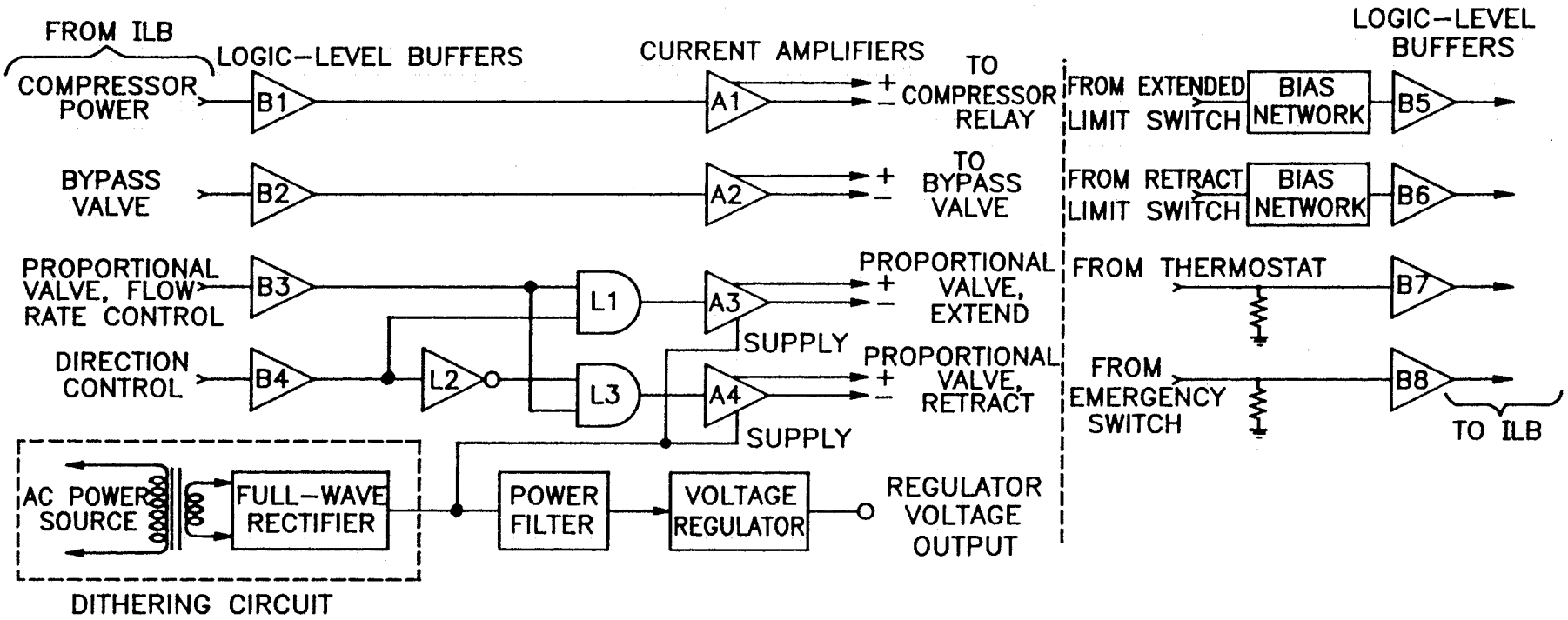
FIG. 3 shows connectivity of the Power Control Module.

FIG. 3 shows the connectivity of the PCM 250. PCM 250 is used to drive high-current elements of the electrical control system. It is also used to interface and buffer various sensor switch inputs and provide them to the computer. Control signals emanate from the ILB 210. Input signals represent hydraulic compressor/pump 34 power, bypass valve 33 energize, flow rate through proportional valve 32, and piston rod 24 direction of movement. Buffers B1, B2, B3, and B4 provide a means for driving high-current amplifier devices A1, A2, A3, and A4. Logic devices L1, L2, and L3 provide a means of direction control. The direction control is a binary logic value which is used to select either A3 or A4 devices but not both. A3 drives the proportional valve 32 for the extend direction, A4 drives the proportional valve 32 for the retract direction.

The valve 32 control signal is a pulse-width modulated digital signal from the ILB 210. It is a low-voltage, low-current, logic-type signal. This is amplified by devices A3 or A4, depending on the direction signal, and is used to drive the applicable solenoid in the proportional flow control valve 32. The power source for these devices is from a pulsing-DC supply. This is used to form a dithering effect. This dithering circuit will be described in greater detail later.

The PCM 250 also provides for buffering of the output of sensors 41, 47, 52 and 54 for the ILB 210. This is provided by buffers B5, B6, B7, and B8. Resistor networks N1 and N2 provide operating current for the magnetic limit switches 52 and 54 located on hydraulic cylinder 30. The buffered signals from B5, B6, B7, and B8 are transmitted electrically to the ILB 210. These signals are logic level and are fed into status register 202 on ILB 210. From this, the computer may access these sensor values.

Figure 4:
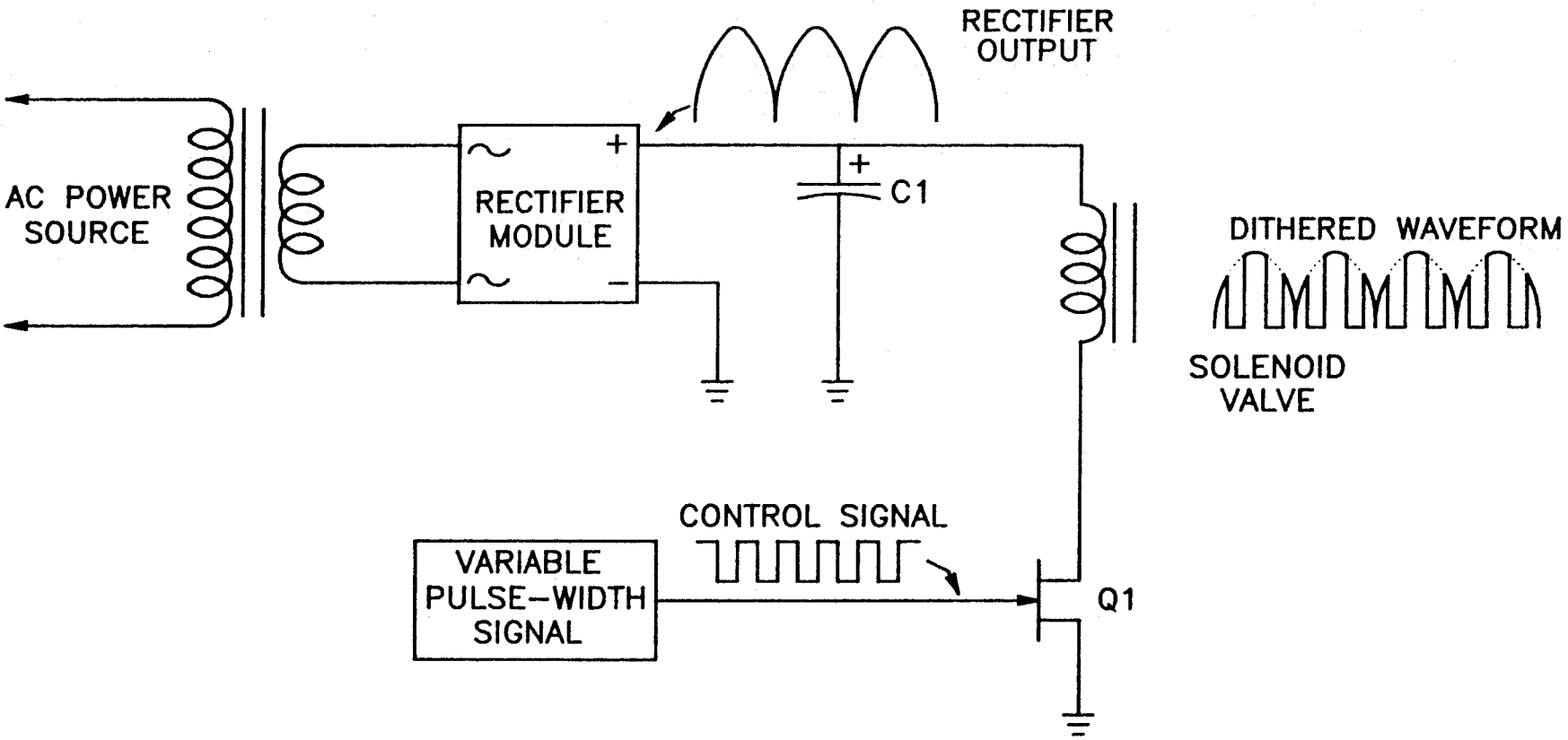
FIG. 4 shows the dither circuit.

FIG. 4 shows how the dithering effect is generated from an alternating current power source. As background, proportional control based on solenoid-type devices requires a controllable current to adjust the position or degree of control. In this preferred embodiment, the proportional control is for hydraulic flow valves. For a given current flowing through the valve solenoid, the valve moves to a particular position. A problem with such solenoid controls is that when a control is placed in a position, it will have a tendency to stick in that position if it stays in that position for a period of time. As a result of this sticking, over time the valve becomes inconsistent in terms of its position with respect to the control current. A common solution in the industry has been to inject a low frequency element into the control valve to vibrate it continually. This is called dithering. The dithering movement of the valve is inconsequential when compared to the control position. The standard dithering technique has been to create a pulsating wave from a direct current power source, then pulse-width modulate this signal to control the solenoid. This requires a dither waveform generator and an amplifying device to supply the generated waveform at the proper current levels to another amplifier device to provide the pulse-width modulation.

As shown in FIG. 4, the dithering circuit of the preferred embodiment produces a dithering effect using alternating instead of direct current. The alternating current line power is fed through a transformer to match the necessary voltage and current requirements of the solenoid. The alternating current is then either full or half wave rectified to generate a pulsating direct current signal. This forms the basis of the dithering waveform. Generally, the alternating current frequency should be 200 Hz or less, because the higher the frequency, the less dithering that will occur because of limitations in the mechanical response of the solenoid. The pulsating direct current signal is then supplied to a current amplifying device Q1 which is modulated by a pulse-width modulation signal to control the solenoid proportional flow valve 32. The dithering enhances consistent valve positioning ability.

Figure 5:
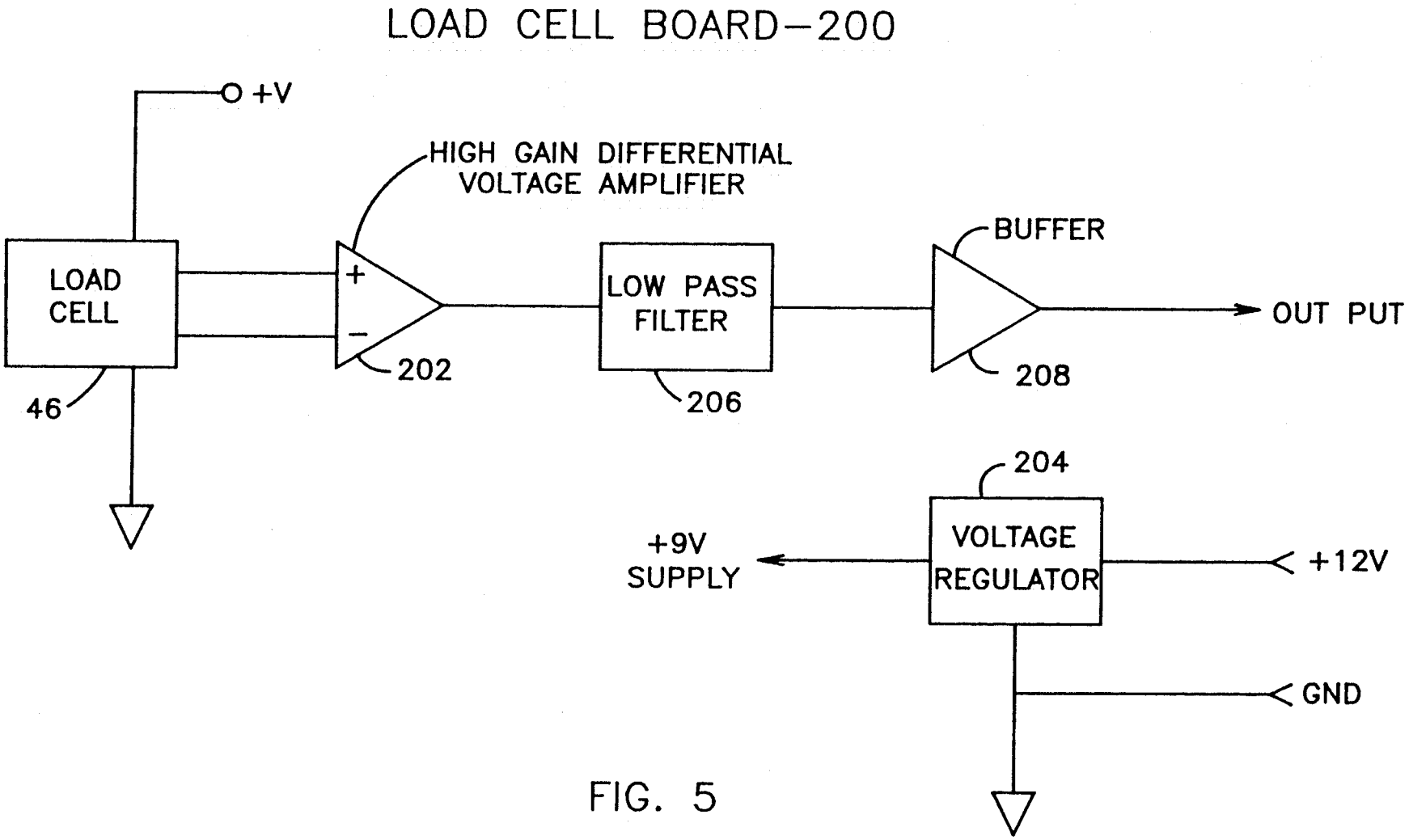
FIG. 5 shows connectivity of the Load Cell Board, FIG. 6 provides a software overview.

FIG. 5 shown the LCB 200 electrical connectivity. As was previously described, load cell 46 is placed between the movable end of the piston rod 24 and tension transmitting device 21. Hence, the load cell 46 moves with the piston rod 24. Attached directly to the load cell is a voltage amplifier device 202, which is required because a typical load cell 46 generates very low voltages. In the preferred embodiment, the amplifier 202 is placed in close proximity to the load cell 46. By amplifying the load cell 46 voltage, noise immunity is significantly enhanced. The load cell 46 develops a voltage from an excitation voltage supplied to it. This load cell 46 voltage signal, typically in the range of 0–10 millivolts, is fed into a differential mode amplifier 202 which linearly amplifies the signal and produces an output relative to the input voltage. The amplification factor is set so that the load cell output covers the operating voltage supply range. Low pass filter 206 removes noise components from extraneous sources. Load cell 46 response is generally below 20 Hz, therefore, the filter 206 cut-off frequency is designed to be approximately 20 Hz. Buffer 208 provides a low-impedance output which is provided to ILB 210 and processed as previously described.

Figure 6:
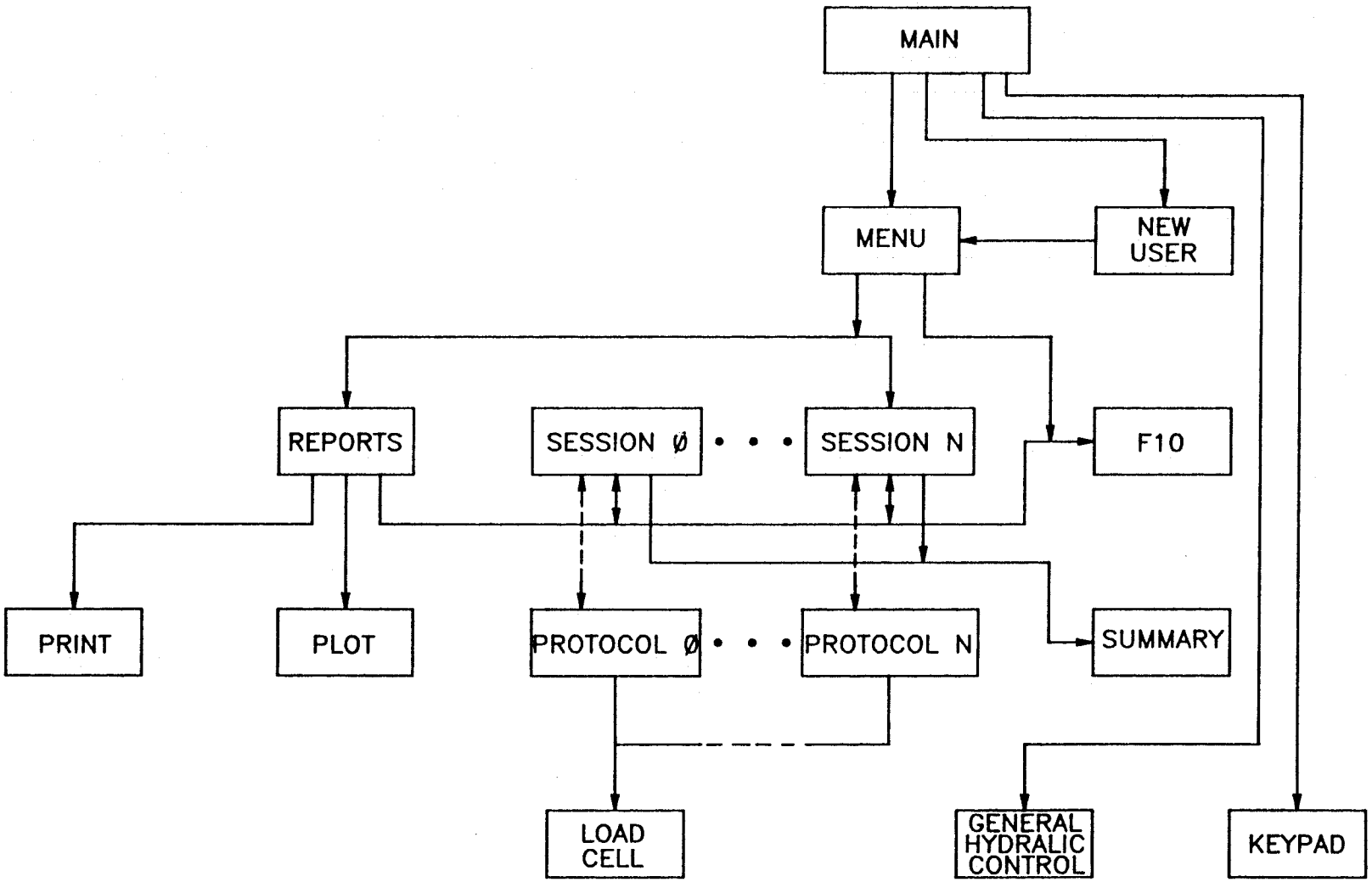

The software provides all control mechanisms for the apparatus. Its function is to integrate sensor information, generate database information, and control the hydraulic system. A unique feature of the apparatus is that it produces a display which compares, in real-time, force generated by the user from current and previous sessions. These forces can be displayed in a graphical form, such as a bar-graph, to provide a motivational workout goal, based on the user's own abilities. FIG. 6 shows an overview of the software system broken into functional modules.

Module MAIN is the system entry point and execution begins at this point. The module initializes data items and hardware control elements, such as the graphics display, hydraulic valves, and position decoder.

The MENU module is responsible for controlling user access to the features of the apparatus. This is done using menu screens from which the user selects various exercises. The user also has the ability to customize the various exercise-type options. This is also performed within the MENU module.

Module NEWUSER is strictly responsible for adding new users to the database. It prompts the user for various relevant information such as their name, ID code, and piston rod 24 extension and retraction limits.

The FIO module is the database management code. It maintains all data structures and provides all file access for the system.

The GENERIC HYDRAULIC CONTROL module provides basic hydraulic services such as piston rod 24 retraction and positioning, valve 32 and 33 controls, and various access services to the ILB 210.

The KEYPAD module provides access to the specialized keypad 60.

The REPORTS module generates printer reports from the database. It invokes the PRINT and PLOT modules. PRINT provides hardware access to the printer. The PLOT module is responsible for generating graph plots for the printer.

The SUMMARY module generates a workout summary on the display 58 immediately after a workout.

The LOADCELL module controls access to the load cell 46 signals.

Of principal importance are the SESSION and PROTOCOL modules. These modules provide the exercise operation of the apparatus. A module exists for each mode of apparatus operation. For instance, SESSION0/PROTOCOL0 might represent an isokinetic mode of workout, where SESSION1/PROTOCOL1 performs work-evaluation testing on a user. Each SESSION/PROTOCOL module set is responsible for a general operation mode. In the former example, a selection of isokinetic workouts might include such exercises as pull-downs, chin-ups, tricep-push-downs, curls, etc. Each mode of operation may encompass a variety of exercises, and for each mode there will exist a SESSION/PROTOCOL set of routines. The software is designed to allow for a number of such modes, where new modes of operation can be added to the current software system. In particular, the SESSION module generates the display screens for the user. The PROTOCOL module controls the hydraulics and data acquisition. The function of each is described in greater detail for a mode 0, isokinetic, workout.

The SESSION module produces displays on display unit 58 while the piston rod 24 extends and retracts at a constant velocity between two positions which are preset for each user. The velocities for the extend and retract directions are preset and may be different. The user selects a mode 0 exercise, such as a chin-up. The system prompts on display 58 the user to connect the appropriate user force application device 16, for this exercise a bar 18, on the tension transmitting device 21, in this embodiment a cable 22. The user is then instructed to remove his or her hands from the bar 18 afterwhich the computer takes calibration readings. After the calibration, the hydraulic compressor/pump 34 is powered up and the bar 18 is positioned to an initial retracted starting point. The display 58 will now display the previous workout averages for each repetition on the bottom of the screen. The user is then prompted to begin the exercise. The apparatus will enter a standby state and the user has about 10 seconds to apply force to the bar 18. If no force is applied during this time interval, hydraulic compressor/pump 34 is powered down and the session is ended. If force is applied, then the apparatus will extend the piston rod 24. This is the extend cycle. The extension occurs at a preset velocity. The user should now exert force on the bar 18. The user may exert no force or force up to the limits of the hydraulics, typically in the range of 800 pounds. The piston rod 24 will continue to extend at the preset velocity. During this time, the display shows a blue bar-graph representation of the instantaneous force applied to the bar on the upper portion of the screen. Below it is a bar-graph of the previous workout force applied for the given position and repetition, this bar is displayed in green. If, during the current workout, the applies more force than the previous workout force, for the given position and repetition, the section of bar-graph representing additional force is displayed in red.

When the extended preset position limit is encountered, the direction of the piston rod 24 and hence the cable 22 and bar 18, changes. This is the retract cycle. When this change of direction occurs, an average of the forces exerted in the extending direction is displayed on a bar-graph in the lower half of the display screen. The bar is placed next to the corresponding average bar for the previous workout and same bar coloring rules are applied as in the above case. In the retract phase, operation is identical to that of extend phase. An instantaneous force bar-graph is displayed and compared to the previous workout as above. The piston rod 24 retracts at a preset retract velocity. When the piston rod 24 reaches the retract position limit a bar-graph representing the average of forces applied during the retract portion of the cycle is displayed. One repetition has now been completed. At the retracted position, the software, once again, enters the standby state. The user may conclude the workout by removing any applied force before the bar reaches the retract limit position. When in the standby state, with no force applied to the bar, the piston rod 24 remains motionless until either force is applied or a preset timeout limit is reached. If force is applied then a new repetition begins. Otherwise, the workout session is completed after the timeout occurs.

Figure 7:
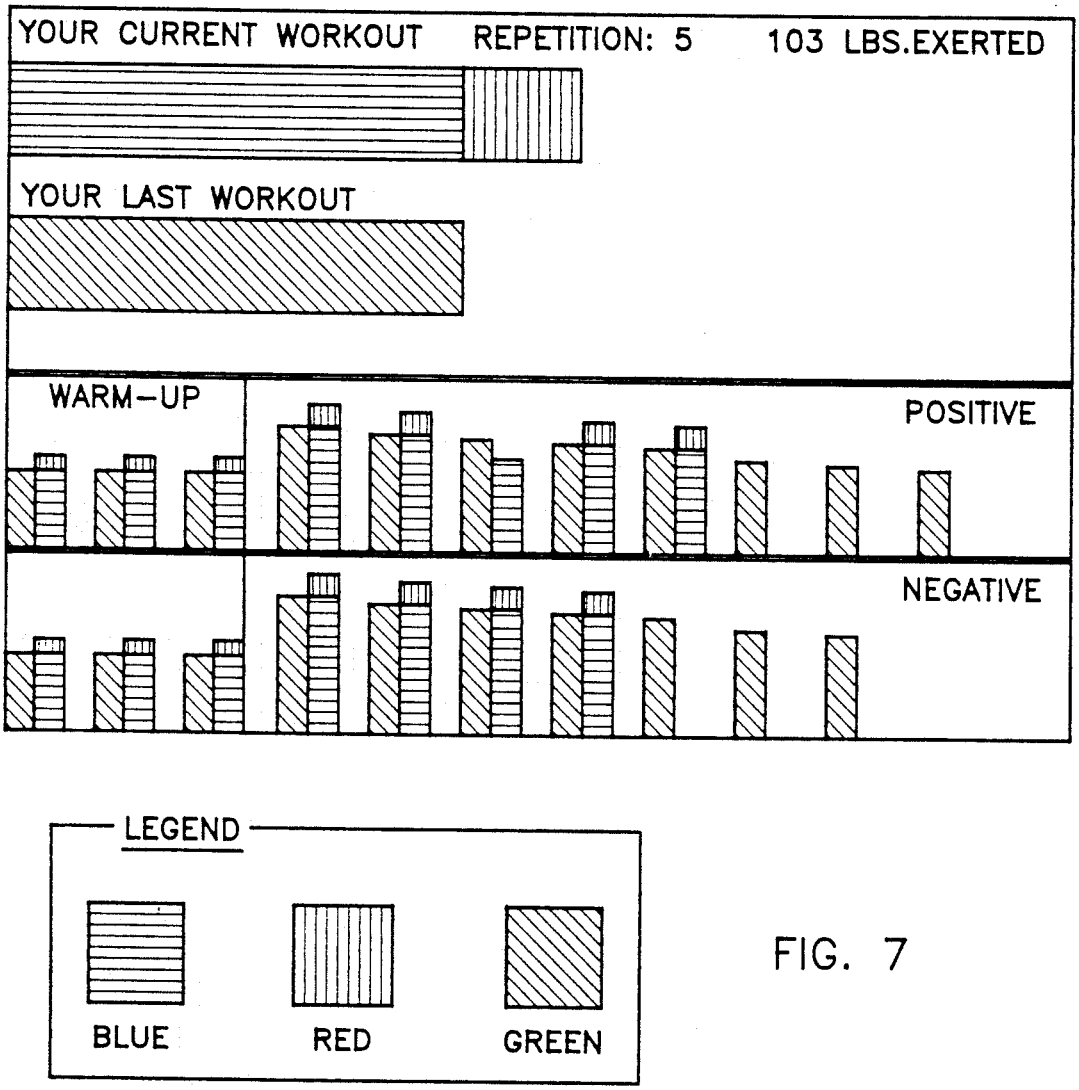
FIG. 7 shows a typical user display seen during exercise.

FIG. 7 depicts what the user will see while an exercise is underway. The user is completing the fifth repetition. The green upper horizontal bar depicts the last workout. The upper blue bar represents the forces currently being exerted less than or equal to the last workout. If the user exceeds his or her last workout, the excess force exerted is displayed in red, as shown. In this embodiment, there are three warm-up repetitions which do not figure in any of the statistical computations. As shown, the user has exceeded his or her previous workout except for the extend cycle of the third repetition after the three warm-up repetitions.

After the workout, SESSION generates comparative statistics for the current and previous workouts. These statistics include, but are not limited to, average force exerted during the entire workout for both the extend and retract cycles. Also, the average force for the single best extend and retract cycles are displayed. These statistics are displayed on the top-half of the screen.

The unique aspect of the display graphics produced by the SESSIONS module is the production of a real-time comparative performance display. As opposed to other machines, which provide non-instantaneous preprogrammed performance goals, this display is tailored to each user's abilities. This is because the user provides the data for performance. The comparative bar-graph display is designed to provide motivation for the user during a workout. When the user out-performs his or her previous workout, the bar-graph shows the excess force as a red-colored bar extension. A user will strive to see the display show red, hence the motivation.

While SESSION is controlling front-end of the user display, the PROTOCOL module controls the actions of the hydraulics and is responsible for obtaining and storing force samples. Operation of the PROTOCOL module is transparent to the user on the apparatus. For each mode of operation, as in the case of the SESSION modules, there is a corresponding PROTOCOL module. The PROTOCOL module is interrupt-driven with exception of various access mechanisms to allow control from the SESSION module. There are two interrupt entry points, from the position counter and from the timer interrupt. An entry point represents a starting point for execution of a routine. Operation is described for the isokinetic mode of operation, like that of the SESSION module described above.

As the cylinder moves a distance corresponding to the resolution of the optical encoder 400, the hardware position counter in the ILB 210 is incremented or decremented dependent on the direction of motion of the piston rod 24. Each time the counter changes, an interrupt is generated. A routine in the PROTOCOL module is executed. This routine monitors the position and is responsible for controlling the direction and velocity of the piston rod 24. It also obtains a load cell reading and stores it in an array, indexed by position, cycle (extend-/retract), and repetition. This array is ultimately used for statistical computations, as well being stored in the database for the next workout session. The SESSION module starts piston rod 24 motion by invoking a START MOTION routine. The START MOTION routine initializes data items used by the interrupt routines. This includes the piston rod 24 position limits, velocities, as well as internal state-variables for the interrupt routines. It initiates the process which opens the proportional valve 32 so that the piston rod 24 starts moving. As the piston rod 24 moves, interrupts are generated by the position counter. This interrupt routine takes a force sample and stores it into the array as mentioned above. It also compares the position, during the extend phase, to the extend limit position. If the limit has been reached, then the proportional valve is closed and time is given to allow the piston rod 24 to stop moving. The routine then exits. The timer interrupt is now invoked after a specified period of time. This routine is responsible changing the direction of motion of the piston rod 24 at the extend-to-retract point. When it is invoked, it moves the piston rod 24 in the retract direction, at a preset velocity. As the piston rod 24 retracts, position interrupts are generated. Again, the position interrupt routine is invoked, data is sampled and stored, and the position is checked against the retract position limit. When the limit is reached, motion is stopped. The SESSION module will enter the standby state. Motion will not begin again until the START MOTION routine is invoked again.

Figure 8:
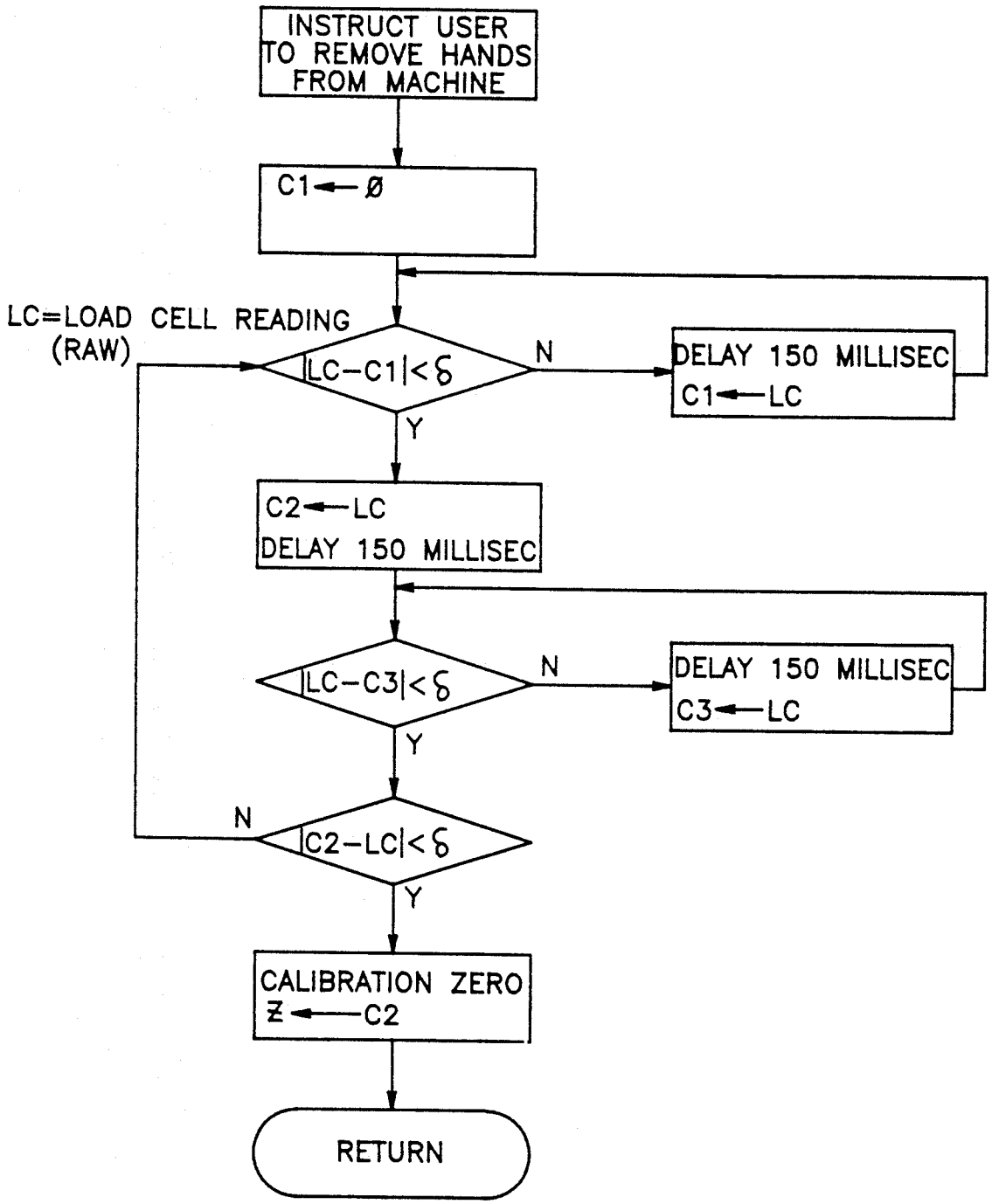
FIG. 8 shows the load cell calibration flow chart.

The user is capable of selecting a variety of user force application devices 16, such as the bar 18 in the previous example. Also a push assembly means 500 may be used. This is described later. Also, extension cables, or the like, may have to be added to the tension transmitting device 21 to allow the user to accomplish the desired exercise. The variety of the items which may be attached to the tension transmitting device, environmental factors, and possible long-term drift in the load cell 46 circuitry make it essential that the load cell be accurately calibrated to produce accurate performance statistics for the user. A flow chart of this calibration process is shown in FIG. 8. Employing a load cell 46 which produces a voltage output which is linear to the force applied to the tension transmitting device 21, a baseline reading can be obtained by reading the load cell voltage when the user is not applying any force. To insure that no variable forces exist on the tension transmitting device 21, the user is instructed to place the appropriate attachment on the tension transmitting device 21 and remove his or her hands from the attachments. Next, a series of readings (C1) are taken between a given time interval. LC refers to a load cell 46 voltage reading. C1, C2, and C3 are scalar variables which hold the various load cell readings used in the algorithm. LC and C1 are compared to each other and if within an error delta (or range), a calibration reading, C2, is taken. Control is now delayed by a given amount to allow time between the next set of readings. Another set of readings (C3) are performed to insure steady force readings. These readings are obtained in the same manner as C1. Finally, C2 is compared to LC to insure consistency between the steady readings. If outside the error delta, the entire calibration process is repeated. Otherwise reading C2 is taken as a zero reference. The C1 and C3 readings attempt to insure no transient forces are applied to the tension transmitting device 21, before and after the calibration reading C2. A time-delay is implemented between readings since the mechanical and electrical response of the load cell circuit is on the order of 10 Hz. This procedure establishes a relative reference of the load cell with respect to the Analog-to-Digital converter 206, thus eliminating any long-term direct current drift. The low-level force sampling routine takes four readings from the Analog-to-Digital converter 206 and averages them. This reduces random noise present in the load cell electronics.

Figure 9:
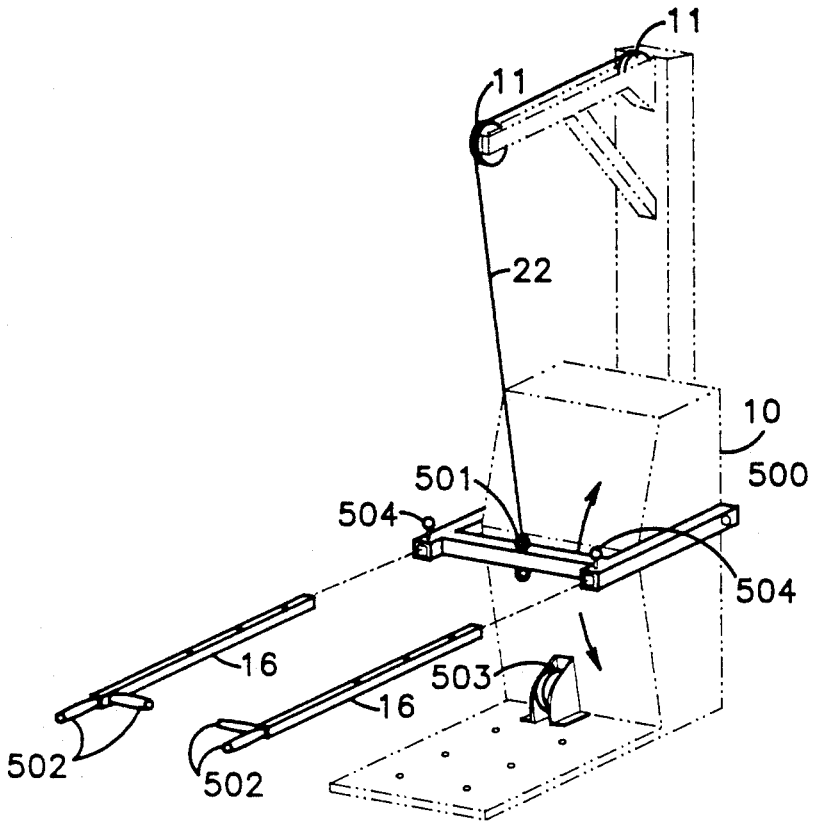
FIG. 9 shows an exercise apparatus having a push assembly means.
Figure 10:
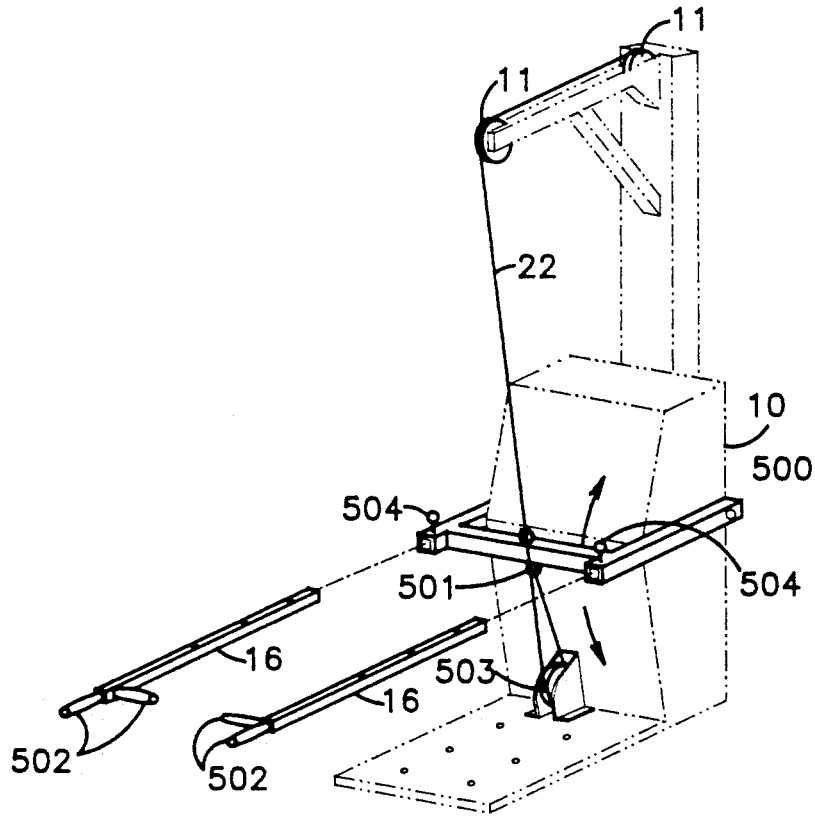
FIG. 10 shows an exercise apparatus having a push assembly means configured for different exercises than those of the configuration shown in FIG. 9, and FIG. 11 shown the operator support of the preferred embodiment.
Figure 11:
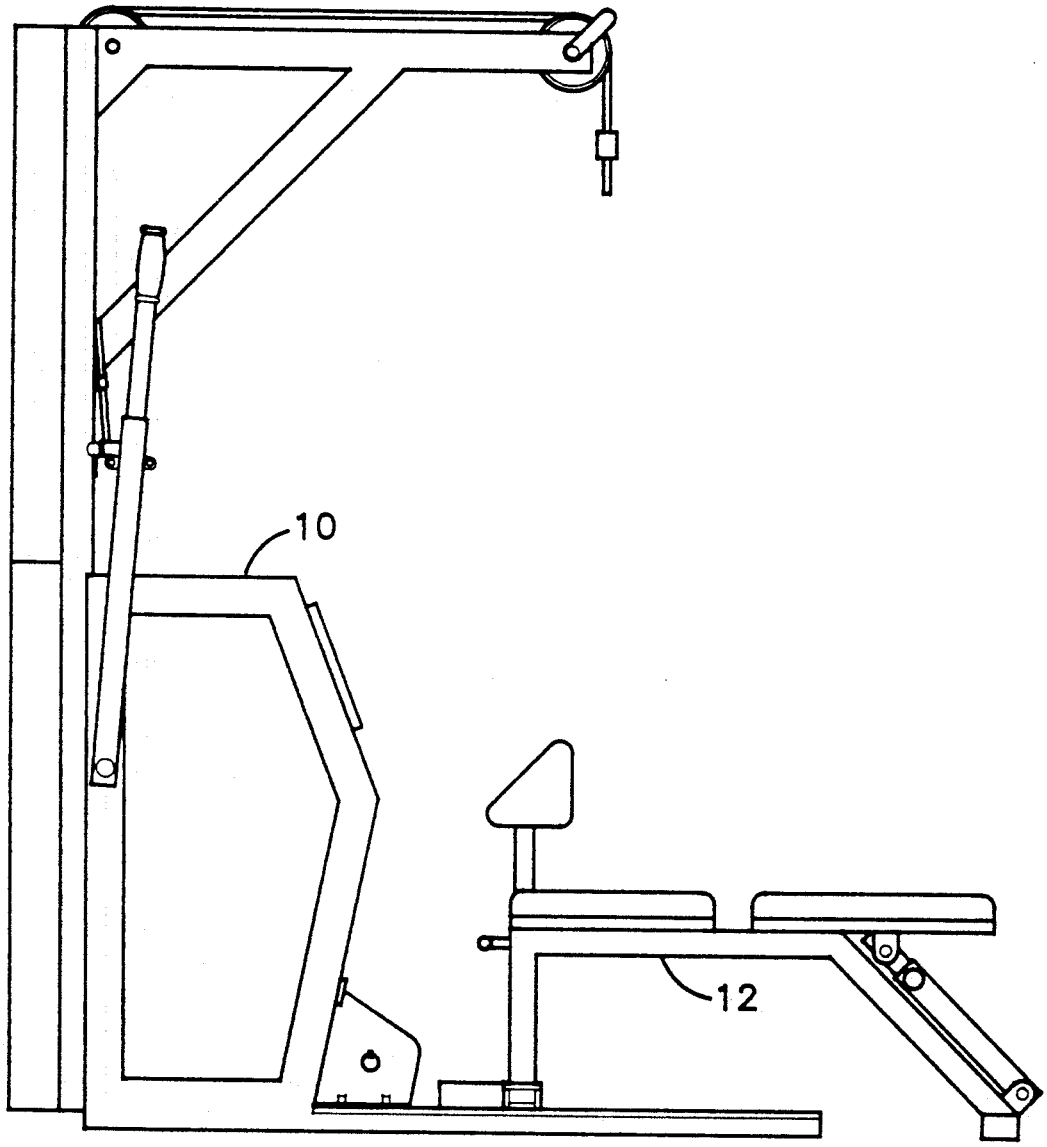

FIGS. 9, 10, and 11 show different configurations for exercise using a push assembly means 500 and a detachably connectable operator support 12. The push assembly means 500 is shown as a "U"-shaped member which is attached via pivot points to a supporting structure 10. Movement of the push assembly 500 is governed by the tension transmitting device 21, in this case cable 22, attached to proper eyelet 501 on the push assembly 500 cross-member. Parallel members of push assembly means 500 are hollow, at least partway therethrough. They have a locking means, in this case spring loaded pop-pins 504, inserted in holes into the hollow at the movable or user ends of the parallel members. User force application device 16, in this case a pair of parallel bars, slide into the hollows of push assembly means 500, forming telescoping extensions. Position holes in parallel bars 16 receive pop-pins 504 and lock parallel bars 16 at the desired extension for the user and the exercise. At the other end of each parallel bar 16 a pair of handles 502 are attached. One handle is mounted in axial alignment with the parallel bar 16. The other handle is mounted transverse or perpendicular to parallel bar 16. Position holes in parallel bars 16 are such that the perpendicular handles may be locked into the push assembly means 500 such that they can either face toward or away from the other parallel bar 16.

FIG. 9 shows the push assembly in a push-down mode of operation. Cable 22 is attached to the top eyelet 501 of the cross-member of push assembly means 500. Downward force is applied by the user onto handles 502 and an opposing upward force is generated on cable 22. The cable extends and retracts in a manner previously described.

FIG. 10 shows the push assembly in a bench press mode of operation. Cable 22 is routed through pulley 503 and connected to the lower eyelet 501 on the cross-member of push assembly means 500. Depending on cable length and apparatus configuration, cable extensions may have to be used. The user applies upward force onto the handles 502, a downward opposing force is generated on the cable 22. The cable extends and retracts in a manner previously described.

FIG. 11 shows the operator support 12, in this case as adjustable exercise bench assembly. The exercise bench assembly 12 can be fastened into threaded holes in the base of supporting structure 10 using a retractable spring-loaded screw down assembly. By being completely retractable into the lower front horizontal leg assembly, the operator support 12 base and the flooring of the user facility are protected. Exercise bench assembly 12 is attached to the base of supporting structure 10 for certain exercises and removed for other exercises which don't require it. Front and rear leg assemblies of the exercise bench assembly 12 are of different height to compensate for the thickness of the base of supporting structure 10.

To use the exercise apparatus, the user decides which of the exercise routines he or she wants to perform and configures the hardware for that exercise. If the operator support 12 is to be used, the user places it in the desired position and may attach it to the supporting structure 10 for added safety. Operator support 12 can be adjusted for the exercise, for example, as a bench for bench presses, or as a chair for overhead exercises. Attachments for arm, leg, or knee support may be added to operator support 12 for exercises such as curls. The user decides which user force application device 16 he or she wishes to use and whether or not he or she will use the push assembly means 500. If necessary, the user adds extensions to the tension transmitting device 21 and correctly routes these extensions over the required pulleys 11 and/or 503. The user will either connect the selected user force application device 16 to the tension transmitting device 21 or push assembly means 500, depending on the exercise selected. If the user force application device 16 is connected to the push assembly means 500, then the proper eyelet 501 of the push assembly means is connected to the tension transmission device 21. The user now assumes the proper exercise position and interfaces the exercise apparatus using keypad 60 and follows the instructions provided to complete the exercise routine.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. In combination with an exercise apparatus having a linearly extendable and retractable tension transmitting device having a first end connected to one of a plurality of user preselected force application devices and a second end connected to a movement control means which regulates the extension and retraction of the tension transmitting device, said control means being operably connected to a force measuring device which determines the tension applied to said tension transmitting device and provides an electronic signal representing a determined tension to a control computer, the improvement comprises:

means for initially calibrating said force measuring device before a user starts an exercise;

wherein said force measuring device is a load cell;

wherein said electronic signal is a load cell voltage output signal; and wherein said initially calibrating means performing an initial calibration by taking at least two samples of said load cell voltage output signal before said user applies any force to said one user preselected force application device, said initially calibrating means comparing said samples of said load cell voltage output signal with the changing factor of said plurality of user preselected force application devices and the environmental factors to determine if said samples of said load cell voltage output signal are within a preselected error range, said initially calibrating means repeating said initial calibration if said samples of said load cell voltage output signal is outside said preselected error range.

2. In combination with an exercise apparatus having a linearly extendable and retractable tension transmitting device having a first end connected to a push assembly means which is connected to at least one of a plurality of user preselected force application devices and a second end connected to a movement control means which regulates the extension and retraction of the tension transmitting device, said control means being operably connected to a force measuring device which determines the tension applied to said tension transmitting device and provides an electronic signal representing a determined tension to a control computer, the improvement comprises:

means for initially calibrating said force measuring device before a user starts an exercise;

wherein said force measuring device is a load cell, wherein said electronic signal is a load cell voltage output signal, and wherein said initially calibrating means performing a initial calibration by taking at least two samples of said load cell voltage output signal before said user applies any force to said one user preselected force application device, said initially calibrating means comparing said samples of said load cell voltage output signal with the changing factor of said plurality of user preselected force application devices and the environmental factors to determine if said samples of said load cell voltage output signal are within a preselected error range, said initially calibrating means repeating said initial calibration if said samples of said load cell voltage output signal is outside said preselected error range.

3. In combination with an exercise apparatus having a supporting structure and a linearly extendable and retractable tension transmitting device supported by said supporting structure, said linearly extendable and retractable tension transmitting device having a first end and a second end, said second end connected to a movement control means which regulates the extension and retraction of the tension transmitting device, said control means being operably connected to a force measuring device which determines the tension applied to said tension transmitting device and provides an electronic signal representing a determined tension to a control computer, the improvement comprises:

(a.) means for initially calibrating said force measuring device before a user starts an exercise; and (b.) a push assembly, one end of said push assembly being pivotally connected to said supporting structure, the other end of said push assembly being connected to at least one of a plurality of user preselected force application device and said first end of said tension transmitting device;

wherein said initially calibrating means performing a initial calibration by taking at least two samples of said electronic signal before said user applies any force to said one user preselected force application device, said initially calibrating means comparing said samples of said electronic signal with the changing factor of said plurality of user preselected force application devices and the environmental factors to determine if said samples of said electronic signal are within a preselected error range, said initially calibrating means repeating said initial calibration if said samples of said electronic signal is outside said preselected error range.

4. The exercise apparatus of claim 3, wherein said push assembly comprises two parallel bars, each of said parallel bars having a structure end, a user end, an outer surface, a hollow at least partway therethrough from said user end toward said structure end for receiving one of said plurality of user preselected force application devices and an opening from said outer surface to said hollow near said user end, a transverse bar connected to said parallel bars toward said user ends of said parallel bars forming a "U" shape, wherein said transverse bar being connected to said first end of said tension transmitting device and said structure ends of said parallel bars pivotally connected to said supporting structure, and a pair of locking means, each of said locking means insertable into said opening for securing one of said plurality of user preselected force application devices inserted into said hollow.

5. The exercise apparatus of claim 4, wherein said one of said plurality of user preselected force application device comprises an elongated bar having a center axis, an outer surface, a push assembly end, a user end, at least one hole therethrough from said outer surface toward said axis and located on said elongated bar towards said push assembly end, and two user handles, wherein one of said handles being in axial alignment with said elongated bar and connected to said elongated bar at said user end, the other of said handles being in transverse alignment with said elongated bar and connected to said elongated bar near said user end, wherein said push assembly end of said elongated bar inserted into said hollows of one of said parallel bars with one of said locking means inserted into said opening of said one of said parallel bars and said at least one hole of said elongated bar to secure said elongated bars to said push assembly.

6. The exercise apparatus of claim 4, wherein said one of said plurality of user preselected force application device comprises a first and a second user force application devices, wherein each of said first and second user force application device comprises an elongated bar having a center axis, an outer surface, a push assembly end, a user end, at least one hole therethrough from said outer surface toward said axis and located on said elongated bar towards said push assembly end, and two user handles, wherein one of said handles being in axial alignment with said elongated bar and connected to said elongated bar at said user end, the other of said handles being in transverse alignment with said elongated bar and connected to said elongated bar near said user end, wherein said push assembly end of said elongated bar of said first user force application device inserted into said hollows of one of said parallel bars of said push assembly with one of said locking means inserted into said opening of said one of said parallel bars and said at least one hole of said elongated bar of said first user force application device to secure said elongated bar of said first user force application device to said push assembly, and wherein said push assembly end of said elongated bar of said second user force application device inserted into said hollows of another of said parallel bars of said push assembly with another of said locking means inserted into said opening of said another of said parallel bars and said at least one hole of said elongated bar of said second user force application device to secure said elongated bar of said second user force application device to said push assembly.

* * * * *